US011597985B2

(12) United States Patent
Hung et al.

(10) Patent No.: US 11,597,985 B2
(45) Date of Patent: Mar. 7, 2023

(54) ALUMINUM ALLOY COMPOSITION AND MANUFACTURING METHOD THEREOF

(71) Applicant: Delta Electronics, Inc., Taoyuan (TW)

(72) Inventors: Fei-Yi Hung, Taoyuan (TW); Yu-Xian Huang, Taoyuan (TW); En-Yi Chu, Taoyuan (TW)

(73) Assignee: DELTA ELECTRONICS, INC., Tao Yuan (TW)

( * ) Notice: Subject to any disclaimer, the term of this patent is extended or adjusted under 35 U.S.C. 154(b) by 97 days.

(21) Appl. No.: 17/395,317

(22) Filed: Aug. 5, 2021

(65) Prior Publication Data

US 2021/0363617 A1 Nov. 25, 2021

Related U.S. Application Data

(62) Division of application No. 16/917,110, filed on Jun. 30, 2020, now abandoned.

(30) Foreign Application Priority Data

Feb. 3, 2020 (CN) ..... 202010078483.2

(51) Int. Cl.

| | |
|---|---|
| ***C22C 21/18*** | (2006.01) |
| ***C22C 1/02*** | (2006.01) |
| ***C22C 21/14*** | (2006.01) |
| ***C22C 21/16*** | (2006.01) |

(52) U.S. Cl.

CPC ..... *C22C 21/18* (2013.01); *C22C 1/026* (2013.01); *C22C 21/14* (2013.01); *C22C 21/16* (2013.01)

(58) Field of Classification Search

None

See application file for complete search history.

(56) References Cited

U.S. PATENT DOCUMENTS

| | | | | |
|---|---|---|---|---|
| 2019/0032175 | A1 | 1/2019 | Martin et al. | |
| 2020/0199716 | A1 * | 6/2020 | Schaedler | C22C 21/12 |

FOREIGN PATENT DOCUMENTS

| | | | |
|---|---|---|---|
| CN | 101484604 | A | 7/2009 |
| CN | 101484604 | B | 1/2013 |
| CN | 108559894 | A | 9/2018 |
| CN | 108884526 | A | 11/2018 |
| CN | 109898000 | A | 6/2019 |
| EP | 0489427 | A1 | 6/1992 |
| GB | 618700 | A | 2/1949 |
| GB | 650905 | A | 3/1951 |
| JP | 2001335923 | A | 12/2001 |
| TW | 172762 | | 11/1991 |
| TW | I448561 | B | 8/2014 |

* cited by examiner

*Primary Examiner* — Daniel J. Schleis

(74) *Attorney, Agent, or Firm* — Kirton McConkie; Evan R. Witt

(57) ABSTRACT

The present disclosure provides a manufacturing method of an aluminum alloy composition. The manufacturing method includes the following steps in the sequence set forth: (S1) providing an aluminum master alloy, wherein the aluminum master alloy comprises aluminum and copper; (S2) adding chromium to the aluminum master alloy and performing a first melting; (S3) adding a tantalum-chromium alloy and performing a second melting; and (S4) adding silver and performing a third melting to form the aluminum alloy composition.

18 Claims, 1 Drawing Sheet

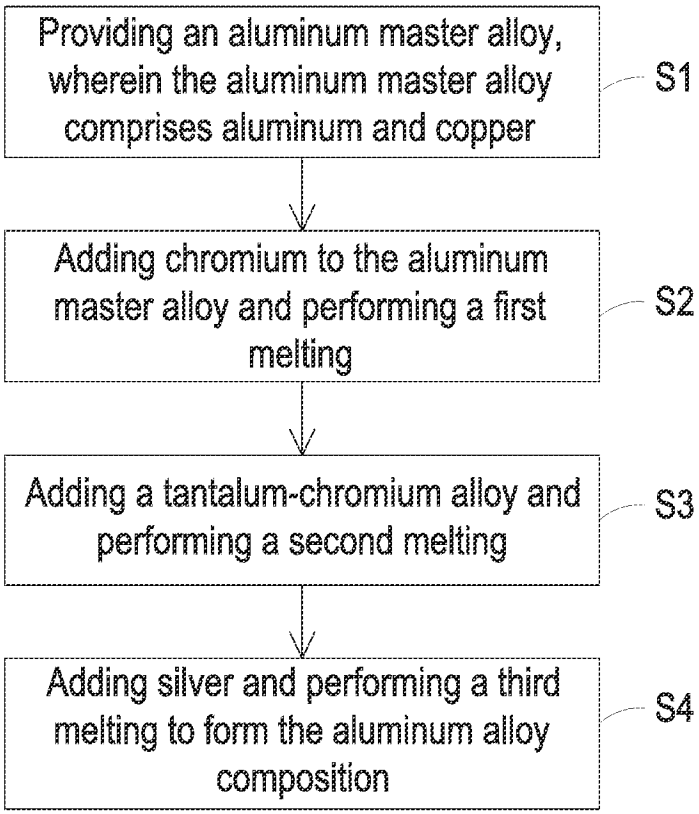
S1
Providing an aluminum master alloy, wherein the aluminum master alloy comprises aluminum and copper
S2
Adding chromium to the aluminum master alloy and performing a first melting
S3
Adding a tantalum-chromium alloy and performing a second melting
S4
Adding silver and performing a third melting to form the aluminum alloy composition

ALUMINUM ALLOY COMPOSITION AND MANUFACTURING METHOD THEREOF

CROSS-REFERENCE TO RELATED APPLICATION

This application is a divisional application of U.S. application Ser. No. 16/917,110 filed on Jun. 30, 2020 and entitled "ALUMINUM ALLOY COMPOSITION AND MANUFACTURING METHOD THEREOF". The entire contents of the above-mentioned patent applications are incorporated herein by reference for all purposes.

FIELD OF THE INVENTION

The present disclosure relates to an aluminum alloy composition, and more particularly to an aluminum alloy composition with excellent corrosion resistance, fatigue resistance, wear resistance and high-temperature resistance, and a manufacturing method thereof.

BACKGROUND OF THE INVENTION

The density of aluminum alloy material is about one third of that of copper or steel. The corrosion resistance, the processability, the thermal conductivity and the electrical conductivity of the aluminum alloy material are excellent. Moreover, the surface treatment characteristics of the aluminum alloy material are good. Therefore, the aluminum alloy material has been widely used in the fields of aerospace, automobiles, bridges, construction, machinery manufacturing, electrical furniture, semiconductors and so on.

In response to the requirements of different application fields, the mechanical properties of the aluminum alloy material are improved by adding other ingredients to an aluminum master alloy. Taking the application of a speed reducer or a force sensor as an example, the aluminum alloy material must meet the basic requirements of corrosion resistance, fatigue resistance, wear resistance, high-temperature resistance, and high mechanical strength. It is a common way to improve the mechanical strength of aluminum alloy by adding a copper alloy or a copper-magnesium alloy to the aluminum master alloy. Thereby, an aluminum-copper-magnesium alloy with high mechanical strength is formed. However, while the mechanical strength of the aluminum-copper-magnesium alloys is improved, the problems of such as poor corrosion resistance, poor fatigue resistance, poor wear resistance and poor high-temperature resistance are caused. It fails to meet the basic requirements of speed reducer or force sensor.

Therefore, there is a need of providing an aluminum alloy composition with corrosion resistance, fatigue resistance, wear resistance and high-temperature resistance, and a manufacturing method thereof, so as to address the above issues encountered by the prior arts.

SUMMARY OF THE INVENTION

An object of the present disclosure is to provide an aluminum alloy composition and a manufacturing method thereof. By adding chromium in an aluminum master alloy with copper contained therein, an aluminum-chromium eutectic composition ($AlCr_2$) is formed, and it is helpful of solving the problems of poor corrosion resistance and poor fatigue resistance. By adding tantalum in the aluminum master alloy, an aluminum-tantalum eutectic composition ($Al_3Ta$) is formed or an aluminum-copper-tantalum eutectic composition ($Al_3(Cu)Ta$ or $Al_2(Ta)Cu$) is further formed due to a sufficient amount of copper contained in the aluminum master alloy, and it is helpful of solving the problem of poor wear resistance. By adding silver, an aluminum-silver eutectic composition ($Ag_2Al$) is formed, or an aluminum-chromium-silver eutectic composition ($Ag_2(Cr)Al$) is further formed due to an additional amount of chromium in the aluminum master alloy, and it is helpful of solving the problem of poor high-temperature resistance.

Another object of the present disclosure is to provide an aluminum alloy composition and a manufacturing method thereof. With the mutually insoluble properties between tantalum and silver, chromium, tantalum and silver are added in the aluminum master alloy with copper contained therein sequentially, and the first melting, the second melting, and the third melting are performed, sequentially. Moreover, the eutectic reaction generated when chromium and silver are added simultaneously is avoided. Thus the eutectic compositions required are formed, and the aluminum alloy composition with excellent corrosion resistance, fatigue resistance, wear resistance and high-temperature resistance is obtained. When the aluminum alloy composition is applied to for example but not limited to the speed reducer or the force sensor, the properties of corrosion resistance, fatigue resistance, wear resistance and high-temperature resistance meets the basic requirements, and it also prevents from increasing the excessive cost of the raw material for the aluminum alloy composition.

In accordance with an aspect of the present disclosure, an aluminum alloy composition is provided. The aluminum alloy composition comprises 4.2 to 5.5 weight percent copper, 1.4 to 2.0 weight percent magnesium, 0.5 to 1.2 weight percent manganese, 0.05 to 1.0 weight percent silicon, 0.05 to 0.8 weight percent chromium, 0.01 to 0.5 weight percent tantalum, 0.01 to 0.5 weight percent silver and the balance of aluminum.

In accordance with another aspect of the present disclosure, a manufacturing method of an aluminum alloy composition is provided. The manufacturing method comprises the following steps in the sequence set forth: (S1) providing an aluminum master alloy, wherein the aluminum master alloy comprises aluminum and copper; (S2) adding chromium to the aluminum master alloy and performing a first melting; (S3) adding a tantalum-chromium alloy and performing a second melting; and (S4) adding silver and performing a third melting to form the aluminum alloy composition.

The above contents of the present disclosure will become more readily apparent to those ordinarily skilled in the art after reviewing the following detailed description and accompanying drawings, in which:

BRIEF DESCRIPTION OF THE DRAWINGS

FIG. 1 is a flow chart illustrating a manufacturing method of an aluminum alloy composition according to an embodiment of the present disclosure.

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

FIG. 1 is a flow chart illustrating a manufacturing method of an aluminum alloy composition according to an embodiment of the present disclosure. In the embodiment, the aluminum alloy composition is applied to for example but not limited to a speed reducer or a force sensor. Since the working environment of the speed reducer or the force sensor is harsh, the aluminum alloy composition used must have high mechanical strength, and meets the requirements of corrosion resistance, fatigue resistance, wear resistance and high-temperature resistance. In the embodiment, as shown in the step S1, an aluminum master alloy is provided firstly. The aluminum master alloy at least contains aluminum and copper. Preferably but not exclusively, in an embodiment, the aluminum master alloy is a 2024 aluminum alloy in accordance with the standards of the Aluminum Association (AA) in the USA. In addition to the aluminum, the 2024 aluminum alloy further contains copper, magnesium, manganese, silicon and other elements. Thereafter, as shown in the step S2, chromium is added to the aforementioned aluminum master alloy for performing a first melting in a melting furnace. Preferably but not exclusively, the vacuum degree of the melting furnace for performing the first melting is less than $10^{-2}$ Pa, and the melting temperature of the melting furnace for performing the first melting is ranged from 700° C. to 800° C., higher than the melting point of aluminum, which is 660.3° C. During the first melting, the raw materials in the melting furnace are stirred continuously for mixing well. In an embodiment, when the chromium content is greater than, for example, 3.8 weight percent (wt. %) relative to the aluminum master alloy, an aluminum-chromium eutectic composition ($AlCr_2$) is formed in the aluminum alloy composition. The aluminum-chromium eutectic composition contains an atomic ratio aluminum/chromium of 1:2. Notably, by adding the chromium in the aluminum master alloy with the copper contained therein, an aluminum-chromium eutectic composition ($AlCr_2$) is formed, and it is helpful of solving the problems of poor corrosion resistance and poor fatigue resistance.

Thereafter, in the step S3, a tantalum-chromium alloy is added into the aforementioned melting furnace for performing a second melting. Preferably but not exclusively, the vacuum degree of the melting furnace for performing the second melting is less than $10^{-2}$ Pa, and the melting temperature of the melting furnace for performing the second melting is ranged from 700° C. to 800° C. During the second melting, the raw materials in the melting furnace are stirred continuously for mixing well. Since the melting point of tantalum is as high as 3017° C., if it is added directly for performing the second melting, it will take a long time to melt. In the embodiment, by adding the tantalum-chromium alloy, the second melting is completed in a shorter melting time. Moreover, the tantalum-chromium alloy provides an additional amount of chromium for the aluminum alloy composition, and the chromium content in the Step S2 is further increased. In the embodiment, by adding the tantalum in the aluminum master alloy, an aluminum-tantalum eutectic composition ($Al_3Ta$) is formed. The aluminum-tantalum eutectic composition contains an atomic ratio aluminum/tantalum of 3:1. In the embodiment, when a sufficient amount of copper is contained in the aluminum master alloy, an aluminum-copper-tantalum eutectic composition ($Al_3(Cu)Ta$ or $Al_2(Ta)Cu$) with wear resistance is further formed. The aluminum-copper-tantalum eutectic composition contains an atomic ratio aluminum/copper/tantalum of 3:1:1 or an atomic ration aluminum/tantalum/copper of 2:1:1. It is helpful of solving the problem of poor wear resistance. In the embodiment, the tantalum-chromium alloy contains an atomic ratio chromium/tantalum of 2:1. Namely, the tantalum-chromium alloy comprises 12 weight percent (wt. %) tantalum and 88 weight percent (wt. %) chromium.

Then, in the step S4, silver is added into the aforementioned melting furnace for performing a third melting. Preferably but not exclusively, the vacuum degree of the melting furnace for performing the third melting is less than $10^{-2}$ Pa, and the melting temperature of the melting furnace for performing the third melting is ranged from 700° C. to 800° C. During the third melting, the raw materials in the melting furnace are stirred continuously for mixing well. Thereby, the aluminum alloy composition of the present disclosure is formed. By adding the silver, an aluminum-silver eutectic composition ($Ag_2Al$) is formed. The aluminum-silver eutectic composition contains an atomic ratio aluminum/silver of 1:2. Furthermore, an aluminum-chromium-silver eutectic composition ($Ag_2(Cr)Al$) is formed by mixing the aluminum-silver eutectic composition and the aforementioned additional amount of chromium. The aluminum-chromium-silver eutectic composition contains an atomic ratio silver/chromium/aluminum of 2:1:1. It is helpful of solving the problem of poor high-temperature resistance. Notably, since the melting point of silver is 961.8° C. far less than the melting point of tantalum 3017° C. and the silver and the tantalum are insoluble with each other, while the silver and the chromium are added simultaneously, an eutectic reaction of the silver and the chromium will occur, and the composition and the performance of aluminum alloy composition are affected. Therefore, with insoluble properties between the tantalum and the silver, the chromium, the tantalum and the silver are added sequentially into the aluminum master alloy with the copper contained therein for performing the first melting, the second melting and the third melting, sequentially. It avoids the eutectic reaction due to simultaneous addition of the chromium and the silver. Moreover, the required eutectic compositions are formed, so as to obtain the aluminum alloy composition with excellent corrosion resistance, fatigue resistance, wear resistance and high-temperature resistance. In the embodiment, the aluminum alloy composition comprises 4.2 to 5.5 weight percent copper, 1.4 to 2.0 weight percent magnesium, 0.5 to 1.2 weight percent manganese, 0.05 to 1.0 weight percent silicon, 0.05 to 0.8 weight percent chromium, 0.01 to 0.5 weight percent tantalum, 0.01 to 0.5 weight percent silver and the balance of aluminum. In some embodiments, the aluminum master alloy contains aluminum, copper, magnesium, manganese and silicon, and further contains zinc. Thereby, the aluminum alloy composition comprises at least 4.2 to 5.5 weight percent copper, 1.4 to 2.0 weight percent magnesium, 0.5 to 1.2 weight percent manganese, 0.05 to 1.0 weight percent silicon, 0.05 to 0.8 weight percent chromium, 0.01 to 0.5 weight percent tantalum, 0.01 to 0.5 weight percent silver, 0.05 to 0.8 weight percent zinc and the balance of aluminum. In the other embodiments, the aluminum master alloy contains aluminum, copper, magnesium, manganese and silicon, and further contains zinc, iron and titanium. Thereby, the aluminum alloy composition comprises at least 4.2 to 5.5 weight percent copper, 1.4 to 2.0 weight percent magnesium, 0.5 to 1.2 weight percent manganese, 0.05 to 1.0 weight percent silicon, 0.05 to 0.8 weight percent chromium, 0.01 to 0.5 weight percent tantalum, 0.01 to 0.5 weight percent silver, 0.05 to 0.8 weight percent zinc, 0.05 to 1.0 weight percent iron, 0.01 to 0.3 weight percent titanium and the balance of aluminum. The present disclosure is not limited thereto.

In the embodiment, after the chromium, the tantalum and the silver are added sequentially into the aluminum master alloy with the copper contained therein for the three times of melting, the aforementioned aluminum alloy composition is further produced by refining, deslagging, homogenization treatment, solution treatment and artificial full aging treatment (Heat treating temper code, T6), so as to prepare a test sample of the aluminum alloy composition, which are utilized for testing the features of fatigue resistance, corrosion resistance, wear resistance, and high-temperature resistance. Certainly, the present disclosure is not limited thereto. For testing the fatigue resistance, the test sample is subjected to a tensile testing at a frequency of 10 Hz under a pressure of 150 Mpa. Thus, a fatigue life (N) is recorded. The more the fatigue life (N) is, the higher the fatigue resistance is. For testing corrosion resistance, the test sample is immersed in a 3.5 weight percent (wt. %) sodium chloride (NaCl) solution and a polarization curve is obtained by the polarization testing. Thus, a corrosion potential (Ecorr V) is further calculated. The more the corrosion potential decreases, the better the corrosion resistance. For testing the wear resistance, solid powders of silicon oxide ($SiO_2$) or aluminum oxide ($Al_2O_3$) are used as erosion particles of parameters, to erode the surface of the test sample at an erosion angle of for example 30°. Thus, an erosion rate is recorded. The erosion rate refers to the percentage of the mass loss of the test sample relative to the total mass of the solid powders of erosion particles. The lower the percentage value is, the better the wear resistance is. As to testing the high-temperature resistance, it is produced by observing the change in tensile strength at room temperature and high temperature.

Notably, by utilizing the insoluble properties between the tantalum and the silver, the chromium, the tantalum and the silver are added sequentially into the aluminum master alloy with the copper contained therein for performing the first melting, the second melting and the third melting, sequentially, so as to obtain the aluminum alloy composition of the present disclosure. It avoids the eutectic reaction due to simultaneous addition of the chromium and the silver, so as to prevent from affecting the composition and the performance of the aluminum alloy composition. Moreover, the required eutectic compositions are formed, so as to obtain the aluminum alloy composition with excellent corrosion resistance, fatigue resistance, wear resistance and high-temperature resistance. In addition, the aluminum alloy composition is applied to for example but not limited to the speed reducer or the force sensor and meets the requirements thereof. It avoids increasing the excessive cost of the raw material for the aluminum alloy composition. In the embodiment, the aluminum alloy composition comprises 4.2 to 5.5 weight percent copper, 1.4 to 2.0 weight percent magnesium, 0.5 to 1.2 weight percent manganese, 0.05 to 1.0 weight percent silicon, 0.05 to 0.8 weight percent chromium, 0.01 to 0.5 weight percent tantalum, 0.01 to 0.5 weight percent silver and the balance of aluminum. In some embodiments, the aluminum master alloy contains aluminum, copper, magnesium, manganese and silicon, and further contains zinc. Thereby, the aluminum alloy composition comprises 4.2 to 5.5 weight percent copper, 1.4 to 2.0 weight percent magnesium, 0.5 to 1.2 weight percent manganese, 0.05 to 1.0 weight percent silicon, 0.05 to 0.8 weight percent chromium, 0.01 to 0.5 weight percent tantalum, 0.01 to 0.5 weight percent silver, 0.05 to 0.8 weight percent zinc and the balance of aluminum. The subsequent exemplary samples are described by combining the procedures of the first melting, the second melting and the third melting to illustrate the effects, which are achieved by sequentially adding the chromium, the tantalum, and the silver to the aluminum master alloy with the copper contained therein.

In a comparative example 1, the 2024 aluminum alloy in accordance with the standards of Aluminum Association (AA) is used as the aluminum master alloy and placed in the melting furnace for performing the first melting. The vacuum degree of the melting furnace for performing the first melting is less than $10^{-2}$ Pa, the melting temperature of the melting furnace for performing the first melting is maintained at 700° C., and the raw materials in the melting furnace are stirred continuously for mixing well during the first melting. After the first melting, the composition of the aluminum master alloy is further produced by solution treatment and artificial full aging treatment, so as to obtain a test sample of the comparative example 1. In the comparative example 1, the composition of the aluminum master alloy at least contains 4.9 weight percent copper, 1.8 weight percent magnesium, 0.9 weight percent manganese, 0.5 weight percent silicon, 0.5 weight percent iron, 0.25 weight percent zinc, 0.15 percent titanium and the balance of aluminum. The test sample of the comparative example 1 is subjected to the tensile testing at the frequency of 10 Hz under the pressure of 150 Mpa. The Fatigue life (N) of the test sample of the comparative example 1 is listed in Table 1. In addition, the test sample of the comparative example 1 is immersed in a 3.5 weight percent (wt. %) sodium chloride (NaCl) for the corrosion potential testing. The obtained corrosion potential (Ecorr V) of the test sample of the comparative example 1 is listed in Table 1.

While in examples 2 to 8, the 2024 aluminum alloy in accordance with the standards of Aluminum Association (AA) and similar to the comparative example 1 is used as the aluminum master alloy. The aluminum master alloy and the chromium added in different weights are placed in the melting furnace for performing the first melting, respectively. The vacuum degree of the melting furnace for performing the first melting is less than $10^{-2}$ Pa, the melting temperature of the melting furnace for performing the first melting is maintained at 700° C., and the raw materials in the melting furnace are stirred continuously for mixing well during the first melting. After the first melting, the aluminum alloy compositions are further produced by solution treatment and artificial full aging treatment, respectively, so as to obtain the test samples of the examples 2 to 8. In the test samples of the examples 2 to 8, the chromium contents (wt. %) contained in the aluminum alloy compositions are listed in Table 1. The copper, the magnesium, the manganese, the silicon, the iron, the zinc and the titanium contained in the aluminum alloy compositions are maintained at the same content ratio relative to the aluminum master alloy. The test samples of the examples 2 to 8 are subjected to the tensile testing and the corrosion potential testing in the same conditions described above. The obtained results of the fatigue life (N) and corrosion potential (Ecorr V) are listed in Table 1.

TABLE 1

| | First melting | Cr (wt. %) | Fatigue life (N) × $10^5$ | Ecorr V |
|---|---|---|---|---|
| Example 1 | Aluminum master alloy | 0 | 0.42 | −0.730 |
| Example 2 | Aluminum master alloy + Cr | 0.05 | 0.47 | −0.741 |
| Example 3 | Aluminum master alloy + Cr | 0.22 | 0.51 | −0.752 |

TABLE 1-continued

| | First melting | Cr (wt. %) | Fatigue life (N) × $10^5$ | Ecorr V |
|---|---|---|---|---|
| Example 4 | Aluminum master alloy + Cr | 0.25 | 0.56 | −0.779 |
| Example 5 | Aluminum master alloy + Cr | 0.67 | 0.60 | −0.805 |
| Example 6 | Aluminum master alloy + Cr | 0.80 | 0.60 | −0.808 |
| Example 7 | Aluminum master alloy + Cr | 0.97 | 0.60 | −0.811 |
| Example 8 | Aluminum master alloy + Cr | 1.22 | 0.60 | −0.811 |

Among the results of the tensile testing and the corrosion potential testing in Table 1, the composition of the aluminum master alloy without the chromium in the comparative example 1 is compared to the aluminum alloy compositions of the examples 2 to 8 of the present disclosure, which are obtained by adding the chromium in different weight to the 2024 aluminum alloy in accordance with the standards of Aluminum Association (AA) and performing the first melting. Accordingly, as the chromium content (wt. %) in the obtained aluminum alloy composition is increased, the fatigue life (N) is increased, the corrosion potential is decreased and the corrosion resistance is enhanced. Among them, when the chromium content in the aluminum alloy composition is in the range of 0.05 to 0.8 weight percent, the fatigue resistance and the corrosion resistance are better. In other words, when the chromium content of the aluminum alloy composition is ranged from 0.05 to 0.8 weight percent, the aluminum-chromium eutectic composition ($AlCr_2$) is formed in the aluminum alloy composition, and it is helpful of solving the problems of poor corrosion resistance and poor fatigue resistance.

While in examples 9 to 15, the 2024 aluminum alloy in accordance with the standards of Aluminum Association (AA) and similar to the comparative example 1 is used as the aluminum master alloy. The chromium is added in the aluminum master alloy, and the aluminum master alloy and the chromium added are placed in the melting furnace for performing the first melting. Then, the tantalum or the tantalum-chromium alloy is further added in different weights for performing the second melting, respectively. The vacuum degree of the melting furnace for performing the second melting is less than $10^{-2}$ Pa, the melting temperature of the melting furnace for performing the second melting is maintained at 700° C., and the raw materials in the melting furnace are stirred continuously for mixing well during the second melting. After the first melting and the second melting are completed sequentially, the aluminum alloy compositions are further produced by solution treatment and artificial full aging treatment, respectively, so as to obtain the test samples of the examples 9 to 15. In the test samples of the examples 9 to 15, the chromium added in the first melting and the tantalum-chromium added in the second melting are maintained at a constant chromium content (wt. %) contained in the aluminum alloy compositions. The chromium contents (wt. %) and the tantalum contents (wt. %) contained in the aluminum alloy compositions of the example 9 to 15 are listed in Table 2. The copper, the magnesium, the manganese, the silicon, the iron, the zinc and the titanium contained in the aluminum alloy compositions are maintained at the same content ratio relative to the aluminum master alloy, and the aluminum alloy compositions comprise the balance of the aluminum The test samples of the examples 9 to 15 are subjected to the wear resistance testing, the solid powder of silicon oxide ($SiO_2$) are used as the erosion particles for erosion medium, and the surfaces of the test samples are eroded at an erosion angle of 30°, respectively. The removal grams of the test samples eroded by the unit grams of the erosion particles of silicon oxide ($SiO_2$) are recorded, so as to obtain the erosion rate 1 ($g/g\times10^{-4}$), respectively. In addition, the test samples of the examples 9 to 15 are subjected to the wear resistance testing, the solid powder of aluminum oxide ($Al_2O_3$) are used as the erosion particles for erosion medium, and the surfaces of the test samples are eroded at an erosion angle of 30°, respectively. The removal grams of the test samples eroded by the unit grams of the erosion particles of aluminum oxide ($Al_2O_3$) are recorded, so as to obtain the erosion rate 2 ($g/g\times10^{-4}$), respectively. The obtained results of the erosion rate 1 ($g/g\times10^{-4}$) and the erosion rate 2 ($g/g\times10^{-4}$) from the wear resistance testing of the test samples of the examples 9 to 15 are listed in Table 2.

TABLE 2

| | Second melting | Cr (wt. %) | Ta (wt. %) | Erosion rate 1 ($g/g \times 10^{-4}$) | Erosion rate 2 ($g/g \times 10^{-4}$) |
|---|---|---|---|---|---|
| Example 9 | Aluminum master alloy + Cr + Ta—Cr alloy | 0.22 | 0.01 | 56 | 78 |
| Example 10 | Aluminum master alloy + Cr + Ta—Cr alloy | 0.22 | 0.23 | 44 | 70 |
| Example 11 | Aluminum master alloy + Cr + Ta—Cr alloy | 0.22 | 0.25 | 32 | 62 |
| Example 12 | Aluminum master alloy + Cr + Ta—Cr alloy | 0.22 | 0.42 | 25 | 59 |
| Example 13 | Aluminum master alloy + Cr + Ta—Cr alloy | 0.22 | 0.51 | 18 | 56 |
| Example 14 | Aluminum master alloy + Cr + Ta—Cr alloy | 0.22 | 0.78 | 17 | 56 |
| Example 15 | Aluminum master alloy + Cr + Ta—Cr alloy | 0.22 | 0.81 | 16 | 55 |

Among the results of the wear resistance testing in Table 2, the aluminum alloy compositions of the examples 9 to 15 of the present disclosure are obtained by sequentially adding the chromium and the tantalum to the aluminum master alloy and performing the first melting and the second melting respectively. Accordingly, as the tantalum content (wt. %) in the obtained aluminum alloy composition is increased, both of the erosion rate 1 ($g/g\times10^{-4}$) and the erosion rate 2 ($g/g\times10^{-4}$) are decreased, and the wear resistance is enhanced. Among them, when the tantalum content in the aluminum alloy composition is in the range of 0.01 to 0.5 weight percent, the wear resistance meets the requirements of the application, such as in the speed reducer or the force sensor. In other words, when the tantalum content of the aluminum alloy composition is ranged from 0.01 to 0.5, an aluminum-copper-tantalum eutectic composition ($Al_3(Cu)Ta$ or $Al_2(Ta)Cu$) with wear resistance is further formed due to the sufficient amount of copper contained in the aluminum alloy composition, and it is helpful of solving the problem of poor wear resistance. Moreover, it also avoids increasing the excessive cost of the raw material for the aluminum alloy composition as well. On the other hand, the additions of the tantalum in the examples 9 to 15 are produced through the tantalum-chromium alloy. It is helpful of shortening the melting time in the second melting. Moreover, the chromium content of the tantalum-chromium alloy is added to increase the chromium content in the previous first melting.

While in examples 16 to 25, the 2024 aluminum alloy in accordance with the standards of Aluminum Association (AA) and similar to the example 11 is used as the aluminum master alloy. The chromium is added in the aluminum master alloy, and the aluminum master alloy and the chromium added are placed in the melting furnace for performing the first melting. The tantalum-chromium alloy is further added for performing the second melting, and then the silver is added in different weight for performing the third melting, sequentially. The vacuum degree of the melting furnace for performing the third melting is less than $10^{-2}$ Pa, the melting temperature of the melting furnace for performing the third melting is maintained at 700° C., and the raw materials in the melting furnace are stirred continuously for mixing well during the third melting. After the first melting, the second melting and the third melting are completed sequentially, the aluminum alloy composition is further produced by solution treatment and artificial full aging treatment, sequentially, so as to obtain the test samples of the examples 16 to 25. In the test samples of the examples 16 to 25 obtained after the first melting, the second melting and the third melting, the chromium content (wt. %) and the tantalum content (wt. %) contained in the aluminum alloy composition are maintained at constant values, which are similar to those of the example 11. The chromium contents (wt. %), the tantalum contents (wt. %) and the silver contents (wt. %) contained in the aluminum alloy compositions of the examples 16 to 25 are listed in Table 3. The copper, the magnesium, the manganese, the silicon, the iron, the zinc and the titanium contained in the aluminum alloy compositions are maintained at the same content ratio relative to the aluminum master alloy, and the aluminum alloy compositions comprise the balance of the aluminum. The test samples of the examples 16 to 25 are subjected to the tensile strength testing at room temperature of 25° C. and high temperature of 200° C. and 250° C. The obtained results are listed in Table 3.

Among the results of the tensile strength testing at room temperature of 25° C. and high temperature of 200° C. and 250° C. in Table 3, the aluminum alloy compositions of the examples 16 to 25 of the present disclosure are obtained by adding the chromium, the tantalum and the silver to the aluminum master alloy and performing the first melting, the second melting and the third melting, sequentially. Accordingly, as the silver content (wt. %) in the obtained aluminum alloy composition is increased, the tensile strength at high temperature of 200° C. and the tensile strength at high temperature of 250° C. are enhanced, and the high-temperature resistance is improved. Among them, when the silver content in the aluminum alloy composition is in the range of 0.01 to 0.5 weight percent, the high-temperature resistance meets the requirements of the application, such as in the speed reducer or the force sensor. In other words, when the silver content of the aluminum alloy composition is ranged from 0.01 to 0.5, an aluminum-chromium-silver eutectic composition ($Ag_2(Cr)Al$) is formed by the additional amount of chromium except for forming the aforementioned aluminum-chromium eutectic composition ($AlCr_2$). It is helpful for solving the problem of poor high-temperature resistance. Moreover, it also avoids increasing the excessive cost of the raw material for the aluminum alloy composition as well. On the other hand, due to the silver and the tantalum are insoluble with each other and the eutectic reaction occurs while the silver and the chromium are added simultaneous, the composition and the performance of the aluminum alloy composition are affected easily. Therefore, by utilizing the insoluble properties between the tantalum and the silver, the chromium, the tantalum and the silver are added sequentially into the aluminum master alloy with the copper contained therein for performing the first melting, the second melting and the third melting, respectively, so as to obtain the aluminum alloy composition of the present disclosure. It avoids the eutectic reaction due to simultaneous

TABLE 3

| | Third melting | Cr (wt. %) | Ta (wt. %) | Ag (wt. %) | Tensile strength at 25° C. (Mpa) | Tensile strength at 200° C. (Mpa) | Tensile strength at at 250° C. (Mpa) |
|---|---|---|---|---|---|---|---|
| Example 16 | Aluminum master alloy + Cr + Ta—Cr alloy + Ag | 0.22 | 0.25 | 0.01 | 462 | 308 | 260 |
| Example 17 | Aluminum master alloy + Cr + Ta—Cr alloy + Ag | 0.22 | 0.25 | 0.22 | 469 | 312 | 264 |
| Example 18 | Aluminum master alloy + Cr + Ta—Cr alloy + Ag | 0.22 | 0.25 | 0.24 | 475 | 316 | 268 |
| Example 19 | Aluminum master alloy + Cr + Ta—Cr alloy + Ag | 0.22 | 0.25 | 0.31 | 481 | 324 | 273 |
| Example 20 | Aluminum master alloy + Cr + Ta—Cr alloy + Ag | 0.22 | 0.25 | 0.37 | 486 | 332 | 277 |
| Example 21 | Aluminum master alloy + Cr + Ta—Cr alloy + Ag | 0.22 | 0.25 | 0.48 | 492 | 336 | 281 |
| Example 22 | Aluminum master alloy + Cr + Ta—Cr alloy + Ag | 0.22 | 0.25 | 0.50 | 497 | 338 | 284 |
| Example 23 | Aluminum master alloy + Cr + Ta—Cr alloy + Ag | 0.22 | 0.25 | 0.53 | 498 | 339 | 285 |
| Example 24 | Aluminum master alloy + Cr + Ta—Cr alloy + Ag | 0.22 | 0.25 | 0.70 | 505 | 340 | 286 |
| Example 25 | Aluminum master alloy + Cr + Ta—Cr alloy + Ag | 0.22 | 0.25 | 0.86 | 511 | 340 | 287 |

addition of the chromium and the silver. Thus, the required eutectic compositions are formed, and the aluminum alloy composition with excellent corrosion resistance, fatigue resistance, wear resistance and high-temperature resistance is obtained. When the aluminum alloy composition of the present disclosure is applied to for example but not limited to the speed reducer or the force sensor, it prevents from increasing the excessive cost of the raw material for the aluminum alloy composition.

In summary, the present disclosure provides an aluminum alloy composition and a manufacturing method thereof. By adding chromium in an aluminum master alloy with copper contained therein, an aluminum-chromium eutectic composition ($AlCr_2$) is formed, and it is helpful of solving the problems of poor corrosion resistance and poor fatigue resistance. By adding tantalum in the aluminum master alloy, an aluminum-tantalum eutectic composition ($Al_3Ta$) is formed or an aluminum-copper-tantalum eutectic composition ($Al_3(Cu)Ta$ or $Al_2(Ta)Cu$) is further formed due to a sufficient amount of copper contained in the aluminum master alloy, and it is helpful of solving the problem of poor wear resistance. By adding silver, an aluminum-silver eutectic composition ($Ag_2Al$) is formed, or an aluminum-chromium-silver eutectic composition ($Ag_2(Cr)Al$) is further formed due to an additional amount of chromium in the aluminum master alloy, and it is helpful of solving the problem of poor high-temperature resistance. Furthermore, with the mutually insoluble properties between tantalum and silver, the chromium, the tantalum, and the silver are added in the aluminum master alloy with the copper contained therein sequentially, and the first melting, the second melting and the third melting are performed, respectively. The eutectic reaction generated when chromium and silver are added simultaneously is avoided. Thereby, the eutectic compositions required are formed, and the aluminum alloy composition with excellent corrosion resistance, fatigue resistance, wear resistance and high-temperature resistance is obtained. When the aluminum alloy composition is applied to for example but not limited to the speed reducer or the force sensor, the properties of corrosion resistance, fatigue resistance, wear resistance and high-temperature resistance meets the basic requirements, and it also prevents from increasing the excessive cost of the raw material for the aluminum alloy composition.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A manufacturing method of an aluminum alloy composition, comprising the following steps in the sequence set forth:

(S1) providing an aluminum master alloy, wherein the aluminum master alloy comprises aluminum and copper;

(S2) adding chromium to the aluminum master alloy and performing a first melting;

(S3) adding a tantalum-chromium alloy and performing a second melting; and (S4) adding silver and performing a third melting to form the aluminum alloy composition.

2. The manufacturing method according to claim 1, wherein the tantalum-chromium alloy in the step (S3) comprises an atomic ratio chromium/tantalum of 2:1.

3. The manufacturing method according to claim 1, wherein the aluminum master alloy in the step (S1) comprises aluminum, copper, magnesium, manganese and silicon, and the aluminum alloy composition in the step (S4) comprises 4.2 to 5.5 weight percent copper, 1.4 to 2.0 weight percent magnesium, 0.5 to 1.2 weight percent manganese, 0.05 to 1.0 weight percent silicon, 0.05 to 0.8 weight percent chromium, 0.01 to 0.5 weight percent tantalum, 0.01 to 0.5 weight percent silver and the balance of aluminum.

4. The manufacturing method according to claim 3, wherein the aluminum master alloy in the step (S1) further comprises zinc, and the aluminum alloy composition in the step (S4) further comprises 0.05 to 0.8 weight percent zinc.

5. The manufacturing method according to claim 4, wherein the aluminum master alloy in the step (S1) further comprises iron and titanium, and the aluminum alloy composition in the step (S4) further comprises 0.05 to 1.0 weight percent iron and 0.01 to 0.3 weight percent titanium.

6. The manufacturing method according to claim 1, wherein an aluminum-chromium eutectic composition is formed after the chromium is added to the aluminum master alloy and the first melting is performed in the step (S2), wherein the aluminum-chromium eutectic composition comprises an atomic ratio aluminum/chromium of 1:2.

7. The manufacturing method according to claim 1, wherein an aluminum-tantalum eutectic composition is formed after the tantalum-chromium alloy is added and the second melting is performed in the step (S3), wherein the aluminum-tantalum eutectic composition comprises an atomic ratio aluminum/tantalum of 3:1.

8. The manufacturing method according to claim 1, wherein an aluminum-copper-tantalum eutectic composition is formed after the tantalum-chromium alloy is added and the second melting is performed in the step (S3), wherein the aluminum-copper-tantalum eutectic composition comprises an atomic ratio aluminum/copper/tantalum of 3:1:1 or an atomic ration aluminum/tantalum/copper of 2:1:1.

9. The manufacturing method according to claim 1, wherein an aluminum-silver eutectic composition is formed after the silver is added and the third melting is performed in the step (S4), wherein the aluminum-silver eutectic composition comprises an atomic ratio aluminum/silver of 1:2.

10. The manufacturing method according to claim 1, wherein an aluminum-chromium-silver eutectic composition is formed after the silver is added and the third melting is performed in the step (S4), wherein the aluminum-chromium-silver eutectic composition comprises an atomic ratio silver/chromium/aluminum of 2:1:1.

11. An aluminum alloy composition comprising:

4.2 to 5.5 weight percent copper, 1.4 to 2.0 weight percent magnesium, 0.5 to 1.2 weight percent manganese, 0.05 to 1.0 weight percent silicon, 0.05 to 0.8 weight percent chromium, 0.01 to 0.5 weight percent tantalum, 0.01 to 0.5 weight percent silver and the balance of aluminum, wherein the chromium, a tantalum-chromium alloy and the silver are added sequentially by performing at least three times of melting.

12. The aluminum alloy composition according to claim 11, further comprising 0.05 to 0.8 weight percent zinc.

13. The aluminum alloy composition according to claim 11, further comprising 0.05 to 1.0 weight percent iron and 0.01 to 0.3 weight percent titanium.

14. The aluminum alloy composition according to claim 11, wherein the aluminum alloy composition comprises an aluminum-chromium eutectic composition, wherein the aluminum-chromium eutectic composition comprises an atomic ratio aluminum/chromium of 1:2.

15. The aluminum alloy composition according to claim 11, wherein the aluminum alloy composition comprises an aluminum-tantalum eutectic composition, wherein the aluminum-tantalum eutectic composition comprises an atomic ratio aluminum/tantalum of 3:1.

16. The aluminum alloy composition according to claim 11, wherein the aluminum alloy composition comprises an aluminum-copper-tantalum eutectic composition, wherein the aluminum-copper-tantalum eutectic composition comprises an atomic ratio aluminum/copper/tantalum of 3:1:1 or an atomic ration aluminum/tantalum/copper of 2:1:1.

17. The aluminum alloy composition according to claim 11, wherein the aluminum alloy composition comprises an aluminum-silver eutectic composition, wherein the aluminum-silver eutectic composition comprises an atomic ratio aluminum/silver of 1:2.

18. The aluminum alloy composition according to claim 11, wherein the aluminum alloy composition comprises an aluminum-chromium-silver eutectic composition, wherein the aluminum-chromium-silver eutectic composition comprises an atomic ratio silver/chromium/aluminum of 2:1:1.

* * * * *